US007134622B2

(12) United States Patent
Biller et al.

(10) Patent No.: US 7,134,622 B2
(45) Date of Patent: Nov. 14, 2006

(54) CHIPPER KNIFE AND HOLDER THEREFOR

(75) Inventors: Sven-Olof Biller, Hudiksvall (SE); Olov Granström, Hudiksvall (SE); Mats Engell, Iggesund (SE)

(73) Assignee: Iggesund Tools AB, Iggesund (SE)

( * ) Notice: Subject to any disclaimer, the term of this patent is extended or adjusted under 35 U.S.C. 154(b) by 0 days.

(21) Appl. No.: 10/332,528

(22) PCT Filed: Jul. 13, 2001

(86) PCT No.: PCT/SE01/01623

§ 371 (c)(1),
(2), (4) Date: Aug. 1, 2003

(87) PCT Pub. No.: WO02/06022

PCT Pub. Date: Jan. 24, 2002

(65) Prior Publication Data

US 2004/0113003 A1 Jun. 17, 2004

(30) Foreign Application Priority Data

Jul. 17, 2000 (SE) ..... 0002680

(51) Int. Cl.
*B02C 18/18* (2006.01)
*B27L 11/00* (2006.01)

(52) U.S. Cl. ..... 241/92; 241/294; 144/241; 407/8

(58) Field of Classification Search ..... 241/92, 241/294; 144/241; 407/108
See application file for complete search history.

(56) References Cited

U.S. PATENT DOCUMENTS

| | | | | | |
|---|---|---|---|---|---|
| 4,709,737 | A * | 12/1987 | Jonsson | 144/241 |
| 4,889,025 | A * | 12/1989 | Collett | 83/835 |
| 5,649,579 | A * | 7/1997 | Kokko et al. | 144/176 |
| D450,556 | S * | 11/2001 | Biller et al. | D8/98 |
| 6,591,878 | B1 * | 7/2003 | Hinchliff | 144/241 |
| 6,722,595 | B1 * | 4/2004 | Frick et al. | 241/92 |

* cited by examiner

*Primary Examiner*—Henry Bennett
*Assistant Examiner*—Jason Y. Pahng
(74) *Attorney, Agent, or Firm*—Fitzpatrick, Cella, Harper & Scinto

(57) ABSTRACT

The invention relates to a chipper knife for chippers of the type comprising a tool (12) which is rotatable on an axis of rotation and is in the form of, for example a drum, disc or truncated conical body, which supports a plurality of such chipper knives. The chipper knife comprises at least one cutting edge (1) which is formed between a flank (2, 2') and a chip guiding surface (4, 4'), and two opposite main surfaces (3, 3') which are adapted to abut against and be retained on the opposite seats (14, 15) of a holder (9, 10) on the tool. At least one main surface (3, 3') of the chipper knife which is located on a wood side of the chipper knife comprises a cross-sectionally convexly bent surface portion (6, 5') which connects to and extends backwards from the flank (2, 2') and the chord of which constitutes at least 20%, preferably at least 30% and, most preferably, at least 40% of the total cross-sectional length of the chipper knife. The invention also relates to a holder for such a chipper knife.

22 Claims, 4 Drawing Sheets

Fig 1
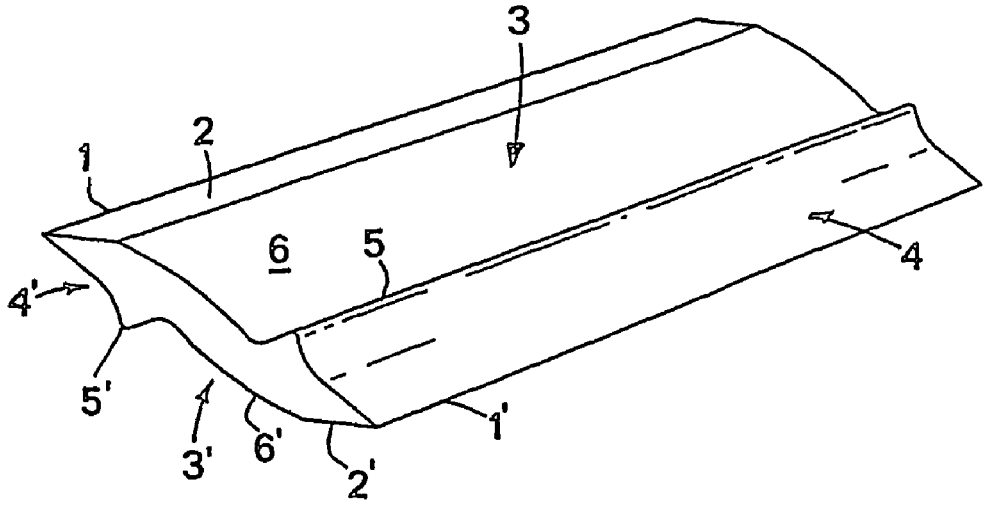
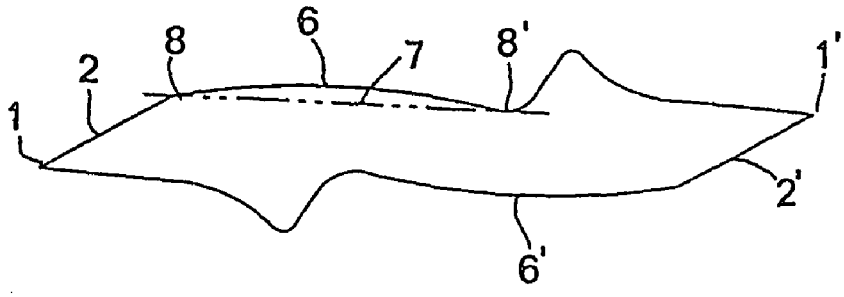
Fig 2

CHIPPER KNIFE AND HOLDER THEREFOR

FIELD OF THE INVENTION

The present invention relates to a chipper knife for chippers of the type comprising a tool which is rotatable on an axis of rotation and is in the form of, for example, a drum, disc or truncated conical body, which supports a plurality of such chipper knives in order to cause, during rotation of the tool, chipping of pieces of wood which are fed to the same, the chipper knife comprising at least one cutting edge which is formed between a flank and a chip guiding surface, and two opposite main surfaces which are adapted to abut against and be retained on opposite seats of a holder on the tool.

The invention also relates to a holder for such chipper knives according to the preamble to claim 13.

BACKGROUND OF THE INVENTION

A plurality of demands which are often contradictory are made on chippers. The most important demand is that the chipper must be able to produce wood chips of a quality that is as high and uniform as possible. Among other things the produced wood chips have to be of uniform size and the amount of oversized chips, as well as the amount of fine material in the form of splinters and shavings have to be small in order to obtain a high yield of the raw material of wood.

Another demand or object to be desired is that the total operative expenses should be as low as possible. For instance, the costs for replacing and/or regrinding of the chipper knives must be low.

An important factor as regards the production of chips of a high and uniform quality is that the top surface or the flank of the chipper knife, i.e. the outermost surface of the chipper knife which during the cutting faces the logs being fed to the chipper, has such a shape and size that during the cutting it interferes with the feeding of the wood as little as possible. In drum chippers the ideal shape of the flank is slightly arched in cross-section with a radius of curvature that corresponds to the radius of curvature of the drum. In disc chippers the ideal shape of the flank is helicoidal, i.e. has a propeller-like shape with a greater angle to the plane of rotation at the centre of the disc than at the periphery of the disc.

Producing chipper knives with such a complicated shape of the flank is technically possible but, in practice, it usually becomes too expensive. On the market there are, in fact, chippers of a large number of makes, types and sizes and, in order to limit the costs, one and the same knife system has to be generally useful in a large number of different chippers without needing to be specially worked and kept in stock for each type of chipper. As a rule, it is thus preferred to produce chipper knives with a constant edge angle and a plane flank and only to twist or arch the other surface parts of the disc and the drum, respectively, which contact the wood. For such a chipper knife to interfere with the feed of the wood as little as possible, it is advantageous if the flank is made with a cross-sectional length that is as small as possible, so that the wood as early as possible should pass over and be guided towards the surfaces of the chipper that follow the chipper knife and that have a correctly arched shape or twisted shape. Such a design makes a good compromise between the demands for a high chip quality and low costs. However, the physical properties of the chipper knife often set lower limits as regards how small the flank can be made since the chipper knife has to have a predetermined minimum cross-sectional thickness in order to resist the strain to which it is exposed.

An important factor when it comes to keeping down the operative expenses is to reduce the time expenditure when adjusting the chipper knives, i.e. the time required for positioning the chipper knives in the chipper when dismantling worn chipper knives and mounting new ones. Most advantageously, the need of adjusting the chipper knives is completely eliminated by the chipper knives not needing to be positioned, but having a predetermined and well-defined position in the holder of the chipper. Moreover, a fixed positioning of the chipper knives has the advantage of these not risking sliding out of the holders or being turned in connection with unbalanced load when in operation. However, in such a knife system, it is not feasible to regrind worn chipper knives without time-consuming handling since this implies that their position in the holder is changed after regrinding, but instead the worn chipper knives are discarded. By forming such chipper knives as symmetric indexable inserts with two opposite cutting edges which, by turning of the chipper knife, can be located in a chipping position, their service life can certainly be doubled, but the cost of production of the chipper knife is after all important as regards the total operative expenses. An important factor as regards keeping down the operative expenses will thus be to be able to limit the cost of production of such chipper knives and, above all, to limit the amount of material in the chipper knife, i.e. make it as small and thin as possible and thereby reduce the material costs. However, this cannot be easily achieved since the chipper knife for reasons of function and strength of material needs to have a certain size and, especially, a minimum thickness in certain cross-sections subjected to heavy loads.

SUMMARY OF THE INVENTION

The present invention aims at providing a chipper knife which eliminates, or at least reduces, the drawbacks of prior-art chipper knives of the type mentioned by way of introduction. In particular, the invention aims at providing a chipper knife which gives a higher chip quality, an increased timber yield and reduced operative expenses by being able to cut chips of high and uniform quality while limiting the amount of oversized chips and the amount of fine material in the form of splinters and chips, and by the material volume of the chipper knife being reduced while maintaining high strength. At least these objects are achieved by means of a chipper knife according to claim 1.

The invention further relates to a holder having a design which results in a distinct and safe retaining of a chipper knife according to the present invention, as well as a predetermined positioning of the chipper knife in a fixed position without any risk of the chipper knife turning as a consequence of unbalance or sliding out of the holder owing to the occurrence of forces. At least these objects are achieved by means of a holder according to claim 13.

The invention is thus based on the understanding that the above-mentioned objects can be achieved by a chipper knife whose main surface facing the wood side of the chipper knife has a cross-sectionally convexly bent surface portion that connects to and extends backwards from the flank and has a length amounting to at least 20% of the total cross-sectional length of the chipper knife. Such a design of the chipper knife makes it possible to form a chipper knife with tapering cross-sectional dimensions in the direction of its terminal edges, i.e. also in the area of the flank, while the heavily loaded cross-sections in the intermediate portion of the chipper knife can be given a dimension that is large enough to handle the strain to which it is subjected. Consequently, as already mentioned, the chipper knife can, be designed with a small and material-saving cross-sectional area. In addition, a convexly bent surface portion gives the possibility of forming the seats of the holder in such a manner that the chipper knife is safely retained in the holder in a distinct and well-defined position without any risk of unintentional incorrect fitting or displacement of position as a consequence of the forces acting on the chipper knife. In other words, positive engagement is obtained between the chipper knife and the seats of the holder in contrast to frictional engagement which is common in this type of installation.

The convexly bent surface portion can optionally extend over essentially the whole main surface or only over a limited part of the same. The cross-sectional length of the convexly bent surface portion measured along an imaginary chord extending between the beginning and the end of the surface portion amounts to at least 20% preferably at least 30% and, most preferably, at least 40% of the total cross-sectional length of the chipper knife.

The opposite main surface of the chipper knife, i.e. the one located on the opposite side in relation to the convexly bent surface portion, can be formed, according to the general idea of invention, in a suitable arbitrary manner. For example, it can be essentially concave, plane, convex or comprise different combinations of these, for instance an essentially plane surface with a concave or trapezoidal recess in the intermediate portion of the chipper knife.

According to the general idea of invention, the chipper knife can optionally be formed with one single cutting edge or as an indexable insert with two cutting edges which, by turning of the chipper knife, can be located by turns in a chipping position. A chipper knife of the indexable insert type has to be symmetric in cross-section in some respect in order to be turnable. For instance, it can exhibit mirror symmetry, i.e. have a symmetric cross-section with regard to a plane perpendicular to its cross-sectional length. In that case, the chipper knife is turnable by turning through 180° in a plane parallel to its longitudinal extension and the wood side and chip side, respectively, of the chipper knife will be the same independently of which cutting edge is placed in a chipping position. However, the chipper knife can also have point symmetry, i.e. be symmetric about a central point. Then the chipper knife is turned over by turning through 180° round its longitudinal axis and the two main surfaces of the chipper knife will alternately face the wood side and the chip side, respectively. Consequently, the chipper knife needs to have both a flank and a chip guiding surface on both sides of a straight line between the cutting edges.

The convexly bent surface portions do not need be part-circular in cross-section, although this is preferred in practice. The bent surface portions might, in fact, have some other convexly bent shape, such as an elliptic or parabolic shape. The convexly bent surface portions might also be composed of a plurality of plane portions extending at an angle relative to one another and together forming a discontinuously bent surface. Furthermore, it is possible that the bent surface portions are composed of two or more continuously bent surfaces with different radii of curvature and also in combination with plane partial surfaces. In addition, the radius of curvature of the surface portion is preferably as large as, and conveniently 0.5–2.0 times the cross-sectional length of the chipper knife between the cutting edges. As regards a surface portion which does not have a part-circular bend, the radius of curvature can be expressed as an equivalent radius of curvature of a corresponding circle that intersects both the ends of the bent surface portion and the point that has the largest distance from a chord between the ends of the surface portion. It is preferred that there is only one convexly bent surface portion on one or on both the main surfaces. However, the convexly bent surface portion might have some form of recess, for instance for positioning or retaining purposes, without deviating from the inventive idea. Such a recess should, however, not reach so deeply as to extend past a chord between the ends of the convexly bent surface portion.

In a preferred embodiment, the length of the flank is smaller than 25% of the cross-sectional length of the chipper knife between the cutting edges and, most preferably, it is smaller than 20% of the cross-sectional length of the chipper knife.

The chipper knife according to the invention is intended to be retained in a holder with a shape and a dimension being adapted to the field of application. The shape of the chipper knife, i.e. the low profile height, which is provided by the material-saving reduction of the cross-sectional area, allows a strong holder since this can be given a correspondingly larger cross-sectional area. The holder comprises one inner and one outer clamping piece having seats that are adapted to abut against the respective main surfaces of the chipper knife. In the preferred embodiment, the seats comprise concavely bent surface portions whose radii of curvature are somewhat smaller than those of the convexly bent surface portions of the chipper knife. When placing the clamping pieces round the chipper knife without applying any clamping force, they will thus abut against one another in two narrow abutment surfaces at a distance from one another. When subsequently pressing the clamping pieces against one another, there is a possibility of deforming the clamping pieces, whereby the greatest clamping forces are achieved in two spaced-apart areas, while the clamping forces in the area therebetween are relatively small, and preferably non-existent since a gap remains between the chipper knife and the seat in this area.

The specification and the claims define the shape of the chipper knife with respect to the cross-sectional appearance, if nothing else is indicated. In practice, the chipper knife is, however, more or less substantially elongated and can in an actual embodiment have a length of about 40 cm, but both greater and smaller lengths are, of course, possible.

In a preferred embodiment of the invention, it is formed as a chipper knife whose both main surfaces each have a cross-sectionally convexly bent surface portion whose respective radius or radii of curvature are opposite to one another. Besides, the convexly bent surface portions are offset relative to one another in such a manner that the surface portion which, with the chipper knife mounted in a chipper, is located on the wood side of the chipper knife, i.e. the side which faces the wood coming to the chipper, is located nearer the processing cutting edge than the bent surface portion on the opposite main surface of the chip side of the chipper knife, i.e. the side of the chipper knife which is oriented in the direction in which the cut chip pieces are moved after the cutting.

Since this chipper knife, in order to be turnable, in cross-section exhibits point symmetry with respect to a central point, an imaginary chord in the cross-section of the chipper knife between the ends of one convexly bent surface portion will be parallel to the corresponding chord of the opposite surface portion. This further means that a normal perpendicular to the chord of a surface portion will be parallel and opposite to the corresponding normal of the opposite surface portion.

In the preferred embodiment, each of the convexly bent surface portions, at one of its ends, abuts on a flank which suitably can be plane or, for instance, slightly bent, and at its other end, on a chip guiding portion comprising a bead that guides the cut chips outwards and away from the holder to which the chipper knife is attached, in order to reduce the wear and tear on the holder and prevent penetration of wood fibres between the chipper knife and an inner clamping piece of the holder. However, the chip guiding portion of the chipper knife could also be formed in many other ways, for instance, without a chip guiding bead.

According to the preferred embodiment of the chipper knife, there are many advantages of the inventive design. Since the convexly bent surface portions on each main surface are offset relative to one another and overlap one another, it is possible to form the chipper knife with an essentially smaller cross-sectional area than the corresponding chipper knife with plane main surfaces because it can be given a cross-sectional shape tapering towards its ends, but all the same give the critical and heavily loaded cross-sections in the intermediate portion of the chipper knife a greater cross-sectional dimension and, thus, improved strength. On the contrary, since the convexly bent surface portions drop towards their respective ends, the cross-sectional length of the flank of the chipper knife can be reduced considerably relative to the corresponding chipper knife with plane main surfaces. As already mentioned, this gives the chipper knife improved operation characteristics and makes it possible to produce chips of a higher quality and with a greater yield of wood. In addition, a chipper knife formed according to the present invention has the further advantage of facilitating the positioning of the chipper knife in the holder since, in practice, there is only one distinct position it can take in the holder.

In a preferred embodiment, one end of a convexly bent surface portion is preferably located essentially opposite to the central point of the opposite surface portion or at a distance that is greater than 15%, preferably greater than 30% and, most preferably, greater than 40% of the length of the chord from one end of the opposite surface portions.

The embodiments below disclose chipper knives being especially designed to produce chips for further use in the cellulose industry. However, it should be understood that a chipper knife formed according to the present invention might also be used to produce such chips or such pieces of veneer that are used for producing so-called OSB boards, in which pieces of veneer that have a size of one or a few centimeters are pressed, in the presence of adhesive, into boards. Chippers for this purpose can be available in the form of drum chippers, as well as disc chippers.

BRIEF DESCRIPTION OF THE DRAWINGS

In the drawings

FIG. 1 is a perspective view of a preferred embodiment of a chipper knife according to the present invention, FIG. 2 is a cross-section of the chipper knife in FIG. 1.

DESCRIPTION OF PREFERRED EMBODIMENTS OF THE INVENTION

Figure 3:
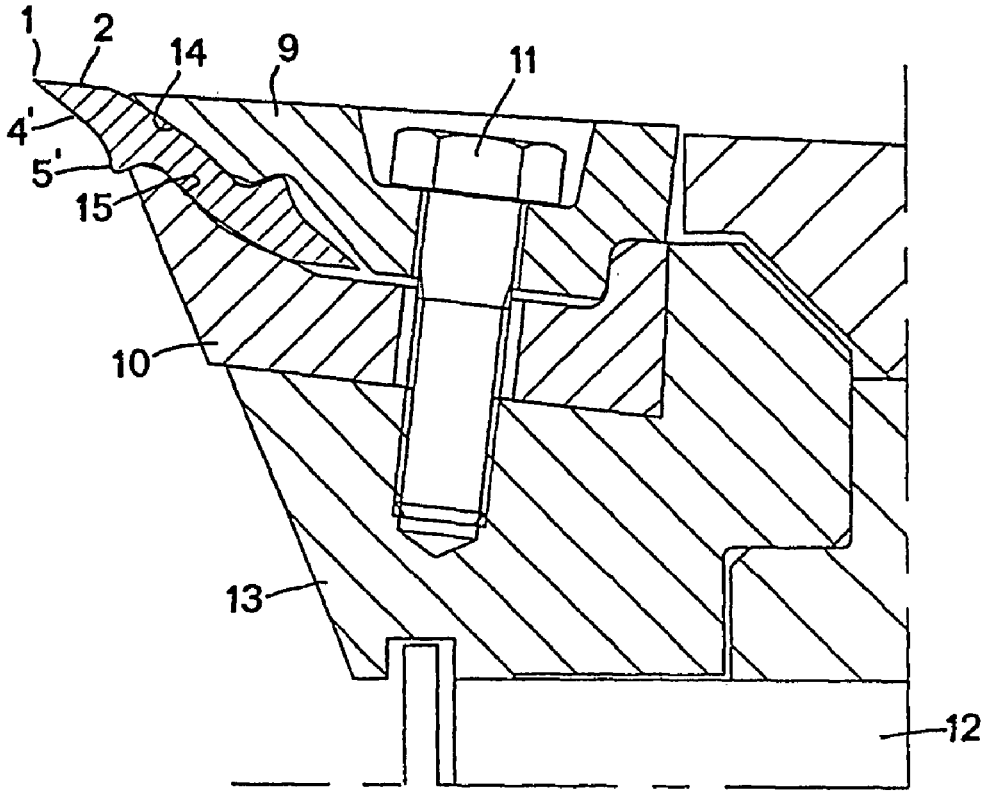
FIG. 3 is a cross-section of a portion of a disc-shaped chipper indicating the location of, and a holder for, the chipper knife according to FIGS. 1 and 2.

FIGS. 1 and 2 show a first preferred embodiment of a chipper knife according to the present invention, on the one hand in a perspective view and, on the other, in cross-section. The chipper knife is of an indexable insert type having two cutting edges 1, 1' and having cross-sectional point symmetry about a central point. On each side of a straight line between the cutting edges, the chipper knife has a flank 2, 2', a main surface 3, 3' and a chip guiding surface 4, 4'. Between the respective main surfaces 3, 3' and the corresponding chip guiding surface, the chipper knife is formed with a chip guiding bead 5, 5'.

Each main surface 3, 3' comprises a cross-sectionally convexly bent surface portion 6, 6'. In the preferred embodiment, the bent surface portions have a part-circular shape in cross-section, and in FIG. 2 a straight line 7 is drawn forming a chord which connects the outer edges or ends 8, 8' of the part-circularly bent surface portion.

As is evident from the drawings, one end of the bent surface portion connects to the plane flank 2, 2' and the other end thereof to a concavely bent surface on one side of the bead 5, 5'. The surface on the other side of the bead constitutes a part of the chip guiding surface 4, 4' and is also concave in the area adjacent to the bead.

Reference is now also made to FIG. 3, in which the chipper knife is shown mounted in a holder of a chipper comprising an outer clamping piece 9 and an inner clamping piece 10 between which the chipper knife is retained by pressing together the clamping pieces 9, 10 with the aid of a plurality of screws 11, of which one is shown in the Figure. The holder is, in its turn, mounted on a rotatable disc 12 via an intermediate piece 13.

The clamping pieces comprise seats 14 and 15, respectively, which abut against the main surfaces 3 and 3', respectively, of the chipper knife. The seats are in cross-section concavely bent with a somewhat smaller radius of curvature than the bent surface portions of the chipper knife. As a result, abutment between the seats of the clamping pieces and the bent surface portions of the chipper knife will take place, seen in cross-section, along two short areas on each side of the chipper knife with a clearance between these two contact surfaces.

In the mounted position of the chipper knife, it is only one of its ends that protrudes from the holder and, in particular, the active cutting edge 1, the flank 2 which is located on the wood side of the chipper knife, i.e. on the side from which the wood is fed to the chipper, and the chip guiding surface 4' which, due to the bead 5', has such a shape that the cut chip is guided in a direction away from the holder. The opposite side of the bead 5' abuts in a surface 18 against a front edge of the inner clamping piece 10.

Since the chipper knife is designed with convexly bent surface portions, the flank 2 can advantageously be made short while the front, outer edge of the outer clamping piece 9 to a corresponding degree can be lengthened forward in the direction of rotation.

As is evident from FIG. 2, the upper, convexly bent surface portion 6 has its greatest distance from the chord 7 exactly in front of the area where the lower, convexly bent surface portion 6' has one of its ends, namely in the transition to the bead 5'. In this cross-section, the chipper knife is subjected to great strain but by the inventive design having convexly and oppositely bent surface portions which are offset relative to one another, the chipper knife obtains a sufficiently great cross-sectional dimension and, thus, the required strength in the heavily loaded cross-sections between the beads 5, 5'.

Figure 4:
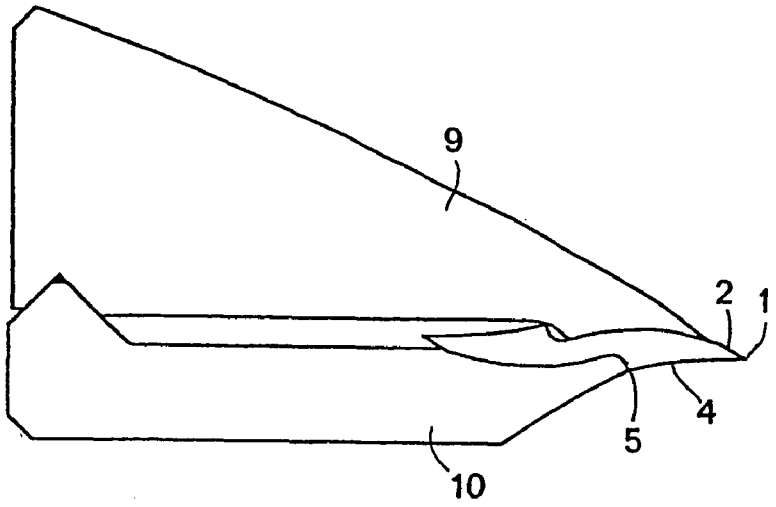
FIG. 4 is a cross-section of a first alternative embodiment of a chipper knife and a holder intended for a drum-shaped chipper.

FIG. 4 shows a first alternative embodiment of a chipper knife and a holder. Also this chipper knife, as well as the previous one, is point symmetric about a symmetry point. However, the holder 9, 10 is specially designed to fit into a drum chipper and the chipper knife is somewhat thinner with smaller beads 5 than in the preceding embodiment.

Figure 5:
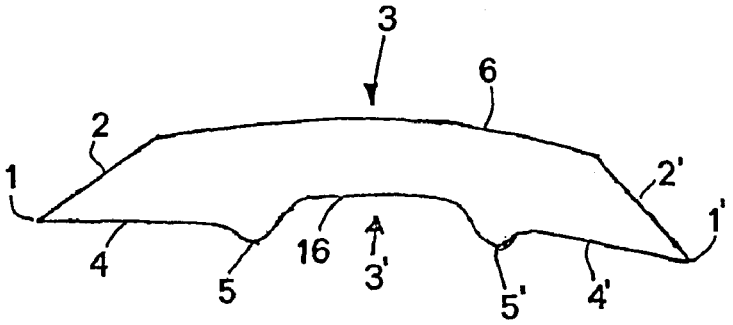
FIG. 5 is a cross-section of a second alternative embodiment of a chipper knife.

FIG. 5 shows a chipper knife, also of an indexable insert type, but in this embodiment the chipper knife is mirror symmetric about a symmetry line through the central point of the chipper knife and perpendicular to a straight line between the cutting edges. In this embodiment, the same main surface 3 will thus always be facing the wood side of the chipper independently of which cutting edge for the time being is located in an active chipping position. In addition, it is only this main surface that is formed with an inventive convexly bent surface portion 6. The opposite main surface 3' has in return the shape of a slightly concavely bent surface 16 surrounded by two chip guiding surfaces 4, 4' and two chip guiding beads 5, 5'.

Figure 6:
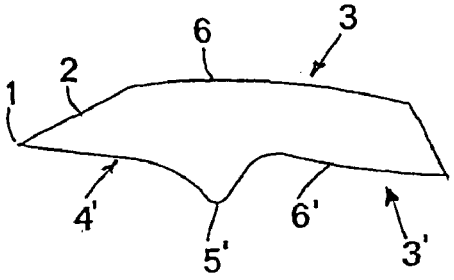
FIG. 6 is a cross-section of a third alternative embodiment of a chipper knife.

FIG. 6 shows an example of a chipper knife with only one cutting edge 1. The opposite main surfaces 3, 3' both exhibit convexly bent surface portions 6, 6'. On the same side as the main surface 3', there is also a chip guiding surface 4' and a chip guiding bead 5'.

Figure 7:
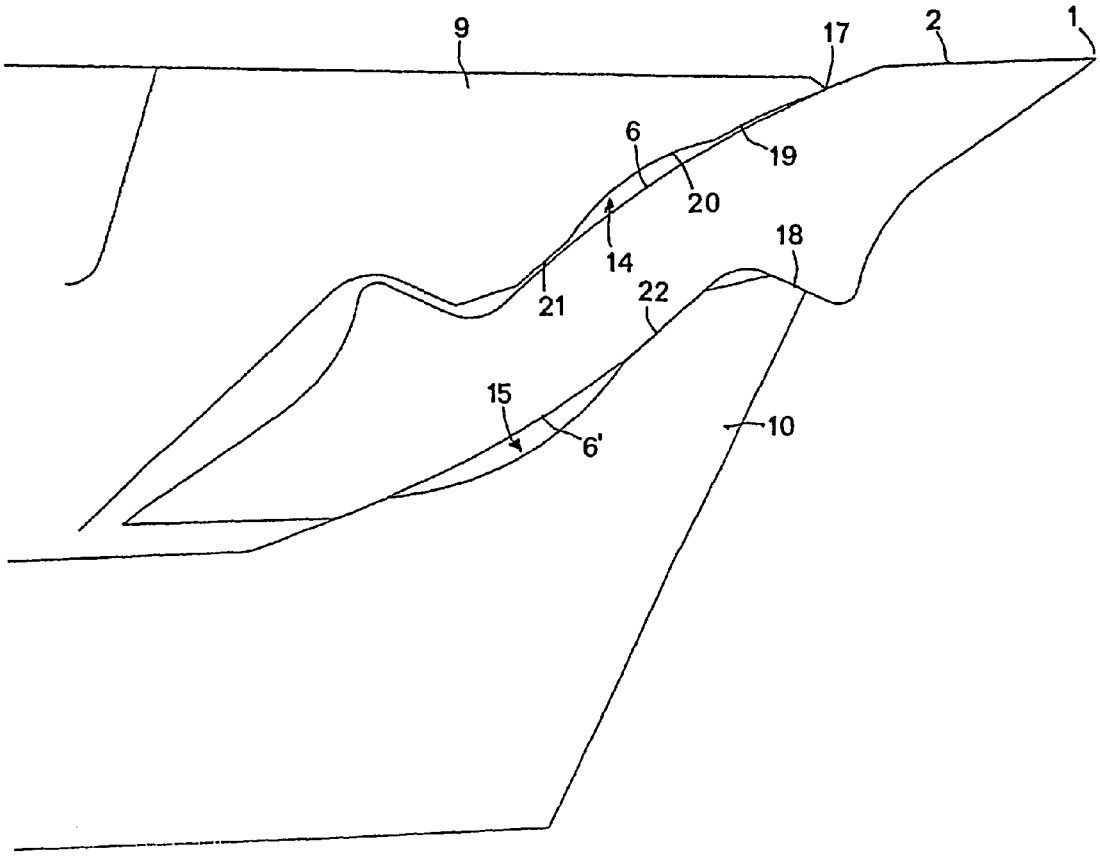
FIG. 7 is an enlarged cross-section of a portion of the holder and the chipper knife in FIG. 3 in a mirror-inverted state, showing the more detailed design of the seats of the holder.

Subsequently, reference is made to FIG. 7 which shows, on an enlarged scale and in a mirror-inverted state, a portion of the holder and the chipper knife according to the embodiment in FIG. 3. The holder is here shown with the clamping pieces 9, 10 in a state where they are not pressed against one another in order to illustrate more clearly the form of the seats 14, 15 in accordance with the invention. As is made evident, the seats are cross-sectionally concavely bent with smaller radii of curvature than the convexly bent surface portions 6, 6' of the chipper knife. In this way, the seats will, in the unloaded state, abut against the chipper knife in only two short areas near the ends of the respective surface portions. Between these areas there is a clearance or a distance between the chipper knife and the respective seats.

According to the invention, such a clearance is arranged between at least the seat 14 of the outer clamping piece 9 and the chipper knife. Seen from a contact point 17 between the front end of the seat of the outer clamping piece 9 and the chipper knife, the concavely bent surface portion of the seat exhibits a first concave surface 19 with a slightly greater radius of curvature than the chipper knife but with a radius centre other than this, a second concave surface 20 with an essentially smaller radius of curvature than the chipper knife and, finally, a plane surface 21. The seat 15 of the inner clamping piece 10 is designed in a corresponding manner except for the seat having a plane surface 22 at its outer end.

Correspondingly to the convexly bent surface portions of the chipper knife, the concavely bent surface portions of the seats can be composed of partial surfaces with different cross-sectional shapes, for instance cross-sectionally part-circular, parabolic or rectilinear partial surfaces.

By designing the seats according to the invention, deformation of the clamping pieces is allowed when pressing these against one another. This results in a favourable distribution of pressure against the chipper knives since the greatest clamping forces will appear in the area of the ends of the respective surface portions 6, 6'. This ensures that the chipper knife is maximally secured in the holder. This is of great importance, not least to prevent penetration of wood fibres between the chipper knife and the respective clamping pieces.

The invention claimed is:

1. A chipper knife for use in wood chippers having a knife support tool rotatable on an axis of rotation for supporting a plurality of such wood chipper knives in order to cause, during rotation of the tool, chipping of pieces of wood which are fed to the tool, said chipper knife comprising a knife having at least one cutting edge which is formed between a flank and a chip guiding surface, and two opposite main surfaces which are provided on opposite first and second sides of the chipper knife and are adapted to abut against and be retained on opposite seats of a holder mounted on the tool, wherein the first side of the chipper knife is the side that, when the knife is mounted in the holder, will face the wood coming to the chipper, and wherein at least the main surface of the knife located on the first side of the chipper knife has a cross-sectionally permanently curved convex surface portion which connects to and extends backwards from the flank and the chord of which constitutes at least 20% of the total cross-sectional length of the chipper knife.

2. A chipper knife as claimed in claim 1, wherein the chord of the cross-sectionally permanently curved convex surface portion constitutes at least 30% of the total cross-sectional length of the chipper knife.

3. A chipper knife as claimed in claim 1, wherein the chord of the cross-sectionally permanently curved convex surface portion constitutes at least 40% of the total cross-sectional length of the chipper knife.

4. A chipper knife as claimed in any one of claims 1–3, wherein said chipper knife has two cutting edges.

5. A chipper knife for use in wood chippers having a knife support tool rotatable on an axis of rotation for supporting a plurality of such wood chipper knives in order to cause, during rotation of the tool, chipping of pieces of wood which are fed to the tool, said chipper knife comprising a knife having at least one cutting edge which is formed between a flank and a chip guiding surface, and two opposite main surfaces which are provided on opposite first and second sides of the chipper knife and are adapted to abut against and be retained on opposite seats of a holder mounted on the tool, wherein the first side of the chipper knife is the side that, when the knife is mounted in the holder, will face the wood coming to the chipper, and wherein at least the main surface of the knife located on the first side of the chipper knife has a cross-sectionally permanently curved convex surface portion formed therein before being mounted in the holder which connects to and extends backwards from the flank and the chord of which constitutes at least 20% of the total cross-sectional length of the chipper knife; said chipper knife being point symmetric as regards a point of symmetry.

6. A chipper knife for use in wood chippers having a knife support tool rotatable on an axis of rotation for supporting a plurality of such wood chipper knives in order to cause, during rotation of the tool, chipping of pieces of wood which are fed to the tool, said chipper knife comprising a knife having at least one cutting edge which is formed between a flank and a chip guiding surface, and two opposite main surfaces which are provided on opposite first and second sides of the chipper knife and are adapted to abut against and be retained on opposite seats of a holder mounted on the tool, wherein the first side of the chipper knife is the side that, when the knife is mounted in the holder, will face the wood coming to the chipper, and wherein at least the main surface of the knife located on the first side of the chipper knife has a cross-sectionally permanently curved convex surface portion formed therein before being mounted in the holder which connects to and extends backwards from the flank and the chord of which constitutes at least 20% of the total cross-sectional length of the chipper knife; said chipper knife having a cross-sectionally permanently curved convex surface portion on each main surface.

7. A chipper knife as claimed in claim 6, wherein the curved surface portions have oppositely directed radii of curvature and are offset relative to one another in such a manner that the curved surface portion which is located on the wood side of the chipper knife is located nearer the processing cutting edge than the curved surface portion which is located on the opposite main surface.

8. A chipper knife as claimed in claim 7, wherein one end of said permanently curved convex surface portion is located more than 15% of the cross-sectional length of the surface portion from the nearest end of the opposite surface portion.

9. A chipper knife as claimed in claims 1, 5, 6, 7 or 8, wherein the cross-sectional length of a flank is smaller than 25% of the cross-sectional length of the chipper knife.

10. A chipper knife as claimed in claims 6, 7 or 8, wherein the radii of curvature of the permanently curved convex surface portions are between 0.5 and 2.0 times the total cross-sectional length of the chipper knife.

11. A chipper knife as claimed in claims 6, 7 or 8, wherein the permanently curved convex surface portions are continuously curved.

12. A chipper knife as claimed in claims 6, 7 or 8, wherein the permanently curved convex surface portions in cross-section have the shape of part-circular surfaces.

13. A chipper knife as claimed in claims 5 or 6, wherein the chord of the cross-sectionally permanently curved convex surface portion constitutes at least 30% of the total cross-sectional length of the chipper knife.

14. A chipper knife as claimed in claims 5 or 6, wherein the chord of the cross-sectionally permanently curved convex surface portion constitutes at least 40% of the total cross-sectional length of the chipper knife.

15. A chipper knife as claimed in claims 5 or 6, wherein said chipper knife has two cutting edges.

16. A chipper knife as claimed in claims 1, 2, 3 or 5 wherein the radius of curvature of the permanently curved convex surface portion is between 0.5 and 2.0 times the total cross-sectional length of the chipper knife.

17. A chipper knife as claimed in claim 9, wherein the permanently curved convex surface portions are continuously curved.

18. A chipper knife as claimed in claim 10, wherein the permanently curved convex surface portions are continuously curved.

19. A chipper knife as claimed in claims 1, 2, 3 or 5 wherein the permanently curved convex surface portions in cross-section have the shape of part-circular surfaces.

20. A chipper knife as claimed in claim 7, wherein one end of said permanently curved convex surface portion is located more than 30% of the cross-sectional length of the surface portion from the nearest end of the opposite surface portion.

21. A chipper knife as claimed in claim 7, wherein one end of said permanently curved convex surface portion is located more than 40% of the cross-sectional length of the surface portion from the nearest end of the opposite surface portion.

22. A chipper knife as claimed in claims 1, 5, 6, 7, 8, 20 or 21 wherein the cross-sectional length of a flank is smaller than 20% of the cross-sectional length of the chipper knife.

* * * * *